US006091208A

United States Patent [19]

Flory, IV

[11] Patent Number: 6,091,208

[45] Date of Patent: Jul. 18, 2000

[54] LAMP IGNITOR FOR STARTING CONVENTIONAL HID LAMPS AND FOR STARTING AND RESTARTING HID LAMPS WITH HOT RESTRIKE CAPABILITY

[75] Inventor: Isaac L. Flory, IV, Blacksburg, Va.

[73] Assignee: Hubbell Incorporated, Orange, Conn.

[21] Appl. No.: 09/280,581

[22] Filed: Mar. 30, 1999

[51] Int. Cl.[7] ..... H05B 37/00

[52] U.S. Cl. ..... 315/290; 315/209 SC; 315/205; 315/276; 315/DIG. 5

[58] Field of Search ..... 315/290, 289, 315/276, 205, DIG. 5, 119, 209 SC, 209 CD, 242

[56] References Cited

U.S. PATENT DOCUMENTS

| | | | |
|---|---|---|---|
| 5,047,694 | 9/1991 | Nuckolls et al. | 315/290 |
| 5,321,338 | 6/1994 | Nuckolls et al. | 315/290 |
| 5,444,334 | 8/1995 | Speaker et al. | 315/209 CD |
| 5,449,980 | 9/1995 | Kiefer et al. | 315/240 |
| 5,594,308 | 1/1997 | Nusckolls et al. | 315/290 |
| 5,757,130 | 5/1998 | Dolan et al. | 315/574 |
| 5,801,494 | 9/1998 | Herres et al. | 315/289 |

*Primary Examiner*—Haissa Philogene
*Attorney, Agent, or Firm*—Jerry M. Presson; Stacey J. Longanecker; Alfred N. Goodman

[57] ABSTRACT

An ignitor is provided to predictably and reliably start a conventional HID lamp, or to start or restart an HID lamp having a hot strike capability such as a high pressure xenon HPS lamp or similar lamp. The ignitor is configured to prevent the premature triggering of a semiconductor switch in a hot restrike circuit due to unwanted high voltage pulses generated by a conventional HID lamp starter circuit in the ignitor. An ignitor is provided that can be used with lag-type ballasts. Another ignitor is provided that can be used with a lead-type ballast which generates a DC bias across the ballast capacitor.

14 Claims, 6 Drawing Sheets

LAMP IGNITOR FOR STARTING CONVENTIONAL HID LAMPS AND FOR STARTING AND RESTARTING HID LAMPS WITH HOT RESTRIKE CAPABILITY

FIELD OF THE INVENTION

The invention relates to an ignitor for use with different types of high intensity discharge (HID) lamps and ballasts. The invention also relates to an ignitor which can be used to start a conventional HID lamp, as well as to start and hot restrike an HID lamp with a hot restrike capability.

BACKGROUND OF THE INVENTION

High intensity discharge (HID) lamps such as metal halide (MH) and high pressure sodium (HPS) lamps have increasingly gained acceptance over incandescent and fluorescent lamps for commercial and industrial applications. HID lamps are more efficient and more cost effective than incandescent and fluorescent lamps for illuminating large open spaces such as construction sites, stadiums, parking lots, warehouses, and so on, as well as for illumination along roadways. An HID lamp comprises at least an arc-tube containing two electrodes, chemical compounds and a fill gas. The fill gas can comprise one or more gases. To initiate operation of the lamp, the fill gas is ionized to facilitate the conduction of electricity between the electrodes.

HID lamps can be difficult to start. An HID lamp such as a conventional HPS lamp uses a 2500 to 4000 volt pulse at least once per half-cycle and at selected times during the cycle in order to start, as set forth in a number of standards such as ANSI C78.1350 on HPS lamps, for example. An ignitor is used to provide the necessary pulses to start the conventional HID lamp. If the lamp is extinguished after lamp operation has elevated lamp temperature, the lamp cannot be restarted until after the lamp cools down and the fill gas can be ionized again. For many types of HID lamps, this lamp cooling period can be between approximately 40 seconds and 2.5 minutes, which can be considered unacceptable in situations where, for example, emergency lighting is desired.

A number of HID lamp-types are being manufactured using high pressure xenon as the fill gas. The fill gas is used because it is easier to ionize than the mercury and sodium in the lamp when the operational temperature of the lamp is low. When used with suitable ignition circuitry, these types of lamps require less time to restart after the lamp is extinguished and the temperature of the lamp has been elevated by lamp operation. As the xenon gas in the lamp ionizes, the relative concentration of the xenon gas begins to decrease (i.e., the xenon gas pressure decreases) while the operating temperature of the lamp and the relative concentration of the sodium vapor increase. Consequently, as the concentration of sodium vapor increases, it becomes easier to ionize the sodium and therefore to illuminate the lamp. To initiate the ionization process under both cold and hot lamp conditions, however, an ignitor and a hot restrike ignitor are required.

Both conventional ignitors and hot restrike ignitors initiate ionization by generating a series of high frequency, high voltage pulses (i.e., typically greater than 3000 volts) across the base of the lamp. Both types of ignitors generate pulses at or near the peak of an input sine wave to generate sufficient energy to ionize the fill gas inside, for example, an HPS lamp. The major difference between a standard ignitor and a hot restrike ignitor is that a restart ignitor produces a pulse which is higher in voltage and contains significantly more energy than a pulse generated by a standard ignitor (e.g., on the order of 7000 volts). This energy is typically stored in one or more capacitors. The pulses are generated when the capacitor(s) discharge through a transformer. Accordingly, a hot restrike ignitor can start a high pressure xenon-type HPS lamp or other lamp having a hot restrike capability, even though the concentration of xenon gas is relatively low as compared with the relative concentration of hot, de-ionized sodium vapor. A standard ignitor must, on the other hand, wait until the HID lamp sufficiently cools and the voltage and energy required to re-ionize the fill gas decreases to a sufficiently low level.

A number of circuits have been developed to hot restrike HID lamps. These hot restrike ignitors generally include resistors, pulse transformers and other components, in addition to a conventional ballast. These devices can reduce system efficiencies and substantially increase system cost.

In commonly-assigned U.S. Pat. Nos. 5,047,694 and 5,321,338, circuits for starting, operating and hot restriking an HPS lamp are described. U.S. Pat. Nos. 5,047,694 and 5,321,338 are incorporated herein by reference. An exemplary circuit is depicted in FIG. 1. In the circuit shown in FIG. 1, terminals 10 and 11 are connected to an alternating current (AC) source 13 which is typically a 240 line voltage source. A power factor correcting capacitor 12 is connected between the terminals 10 and 11. An inductive ballast indicated generally at 14 is typically a lag-type ballast and has terminals connected to the terminal 10 and to one terminal of an HPS lamp 16, respectively. The other terminal of the HPS lamp 16 is connected to terminal 11 such that the ballast 14 and the lamp 16 are in series across the AC source terminals 10 and 11. The ballast 14 is a tapped ballast having winding portions 18 and 19 and a tap 20 provided at the junction therebetween.

A semiconductor switch 63 such as a silicon-controlled rectifier (SCR) or the like is connected so that one end of its switchable conductive path is connected to the end of the first portion 18 of the ballast. The other end of the conductive path of the SCR 63 is connected to the tap 20 via a storage capacitor 62. A number of sidacs 64 or other breakdown devices are connected between the gate and the anode of the SCR 63. A current-limiting resistor 65 is provided in series with the sidacs 64. If the voltage on the capacitor 62 increases to a level which reaches or exceeds the threshold voltage of the breakdown devices 64, the sidacs 64 become conductive, placing the SCR 63 in a conductive state. Accordingly, the capacitor 62 discharges through the portion 18 of the ballast. Because the winding portions 18 and 19 of the ballast are electromagnetically coupled, the portion 18 of the ballast operates as the primary of a transformer in that a voltage is induced in the winding portion 19. The high voltage generated in the winding portion 19 of the ballast 14 is imposed on the lamp 16. The relationship of the winding portions 18 and 19 is selected to create a voltage using the SCR 63 and the sidacs 64 which is sufficiently high to start a lamp 16.

A charging circuit for the capacitor 62 is connected between the tap 20 and the terminal 11 at the other side of the AC power source 13. This charging circuit includes a two diodes 69, a pumping capacitor 66 and two radio frequency chokes 67 connected in series between the tap 20 and the terminal 11. Two diodes 68 are connected between the capacitor 66 and a thermostatic switch 70 and are poled in the opposite direction from the diodes 69. The charging circuit provides for the controlled, step-charging of the storage capacitor 62. The switch 70 provides for the automatic turn-off of the charging circuit for the capacitor 62 after a selected period of time has elapsed.

The starter circuit 60 depicted in FIG. 1 further comprises a more conventional HPS lamp starting aid comprising a capacitor 76 connected in series with a resistor 78, a choke 80 and a sidac 82 or similar breakdown device, which is connected between the resistor-capacitor junction and the tap 20. The charge on the capacitor 76 increases through the resistor 78 and the choke 80 until the breakdown voltage of the sidac 82 is reached. The capacitor 76 then discharges through the portion 18 of the ballast 14 to produce a starting voltage pulse.

The conventional HPS lamp starting aid of the starting circuit 60 is operable when the lamp is cold. To hot restrike the lamp, however, the circuit described above for charging and discharging the capacitor 62 is needed. The starting circuit 60 is configured for operation with lamps that respond to hot restriking following a momentary power interruption. Conventional HPS lamps, which requiring cooling before they can be started after a power interruption, do not respond well to the type of ignition pulse generated by the circuit depicted in FIG. 1. On the other hand, a lamp such as a 600 watt high pressure xenon HPS lamp does not start reliably using a conventional ignitor. The circuit depicted in FIG. 1 is disadvantageous because it does not reliably and predictably generate the high voltage pulses required to start the lamp. Additional high voltage starting pulses are generated by the components 76, 78 and 82 of the conventional starting circuit, which appear in an attenuated form across the semiconductor switches 64. These additional pulses cause premature triggering of the SCR 63. This early activation of the SCR 63 results in a reduced ignitor pulse being generated by the capacitor 62 since its energy is being discharged at a lower voltage level.

Accordingly, a need exists for an ignitor which can predictably and reliably start a conventional HID lamp, or start or restart an HID lamp having a hot restrike capability such as a high pressure xenon HPS lamp. Such an ignitor is also useful since an increasing number of HID lamps such as HPS lamps are being manufactured with high pressures of xenon gas in order to improve system performance and reduce the amount of mercury that is used in the lamps. As stated previously, consumers may consider the time elapsing between when a conventional HID lamp is extinguished and its next ignition to be too long, and may opt to use a high pressure xenon HPS lamp or similar lamp that does not need to cool prior to restart for more effective emergency lighting. Thus, a need exists for an ignitor which allows consumers to choose the type of HID lamp that they wish to use and which will operate with either a conventional HID lamp or a lamp capable of hot restrike such as a high pressure xenon HPS lamp.

SUMMARY OF THE INVENTION

The above-described problems with ignitors for HID lamps are overcome by the present invention which provides a number of ignitors that are each configured to predictably and reliably start a conventional HID lamp, or to start or hot restrike an HID lamp such as a high pressure xenon HPS lamp or similar lamp.

The present invention also provides ignitors that can be used with lag-type ballasts, as well as an ignitor that can be used with a lead-type ballast.

In accordance with an aspect of the present invention, an ignitor comprises a starter circuit for a conventional HID lamp and a starter and hot restrike circuit for HID lamps having a hot restrike capability. The starter circuit is connected to the common line via inductors in the starter and hot restrike circuit in lieu of using a separate choke.

In accordance with another aspect of the present invention, an ignitor comprises a starter circuit for a conventional HID lamp and a starter and hot restrike circuit for HID lamps having a hot restrike capability. The starter and hot restrike circuit comprises a low pass filter to attenuate unwanted high voltage pulses generated via the starter circuit, which can cause premature triggering of a semiconductor switch in the starter and hot restrike circuit.

In accordance with yet another aspect of the present invention, an ignitor comprises a starter circuit for a conventional HID lamp and a starter and hot restrike circuit for HID lamps having a hot restrike capability. The starter and hot restrike circuit comprises a four-pole low pass filter to attenuate unwanted high voltage pulses generated via the starter circuit, which can cause premature triggering of a semiconductor switch in the starter and hot restrike circuit.

In accordance with still yet another aspect of the present invention, an ignitor is connected to a lead-type ballast having a ballast capacitor. The ignitor comprises a series connected resistor, diode and capacitor circuit to allow a DC bias to develop across the ballast capacitor during alternating cycles to assist the lamp into operation during a hot restrike cycle.

BRIEF DESCRIPTION OF DRAWINGS

The various aspects, advantages and novel features of the present invention will be more readily comprehended from the following detailed description when read in conjunction with the appended drawings, in which.

Throughout the drawing figures, like reference numerals will be understood to refer to like parts and components.

DETAILED DESCRIPTION OF THE PREFERRED EMBODIMENTS

Figure 1:
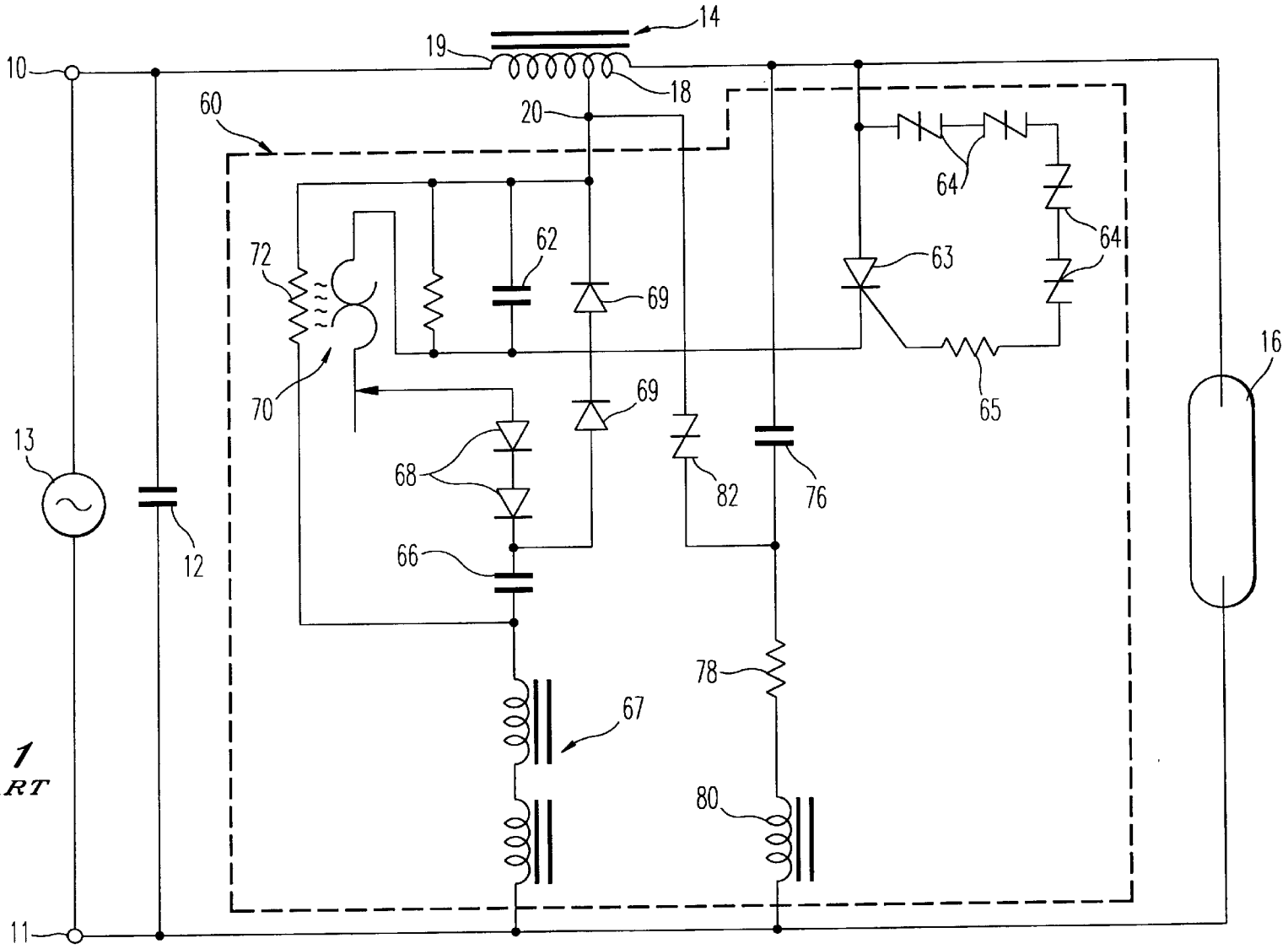
FIG. 1 PRIOR ART
FIG. 1 a schematic diagram of an existing ignitor.
Figure 2:
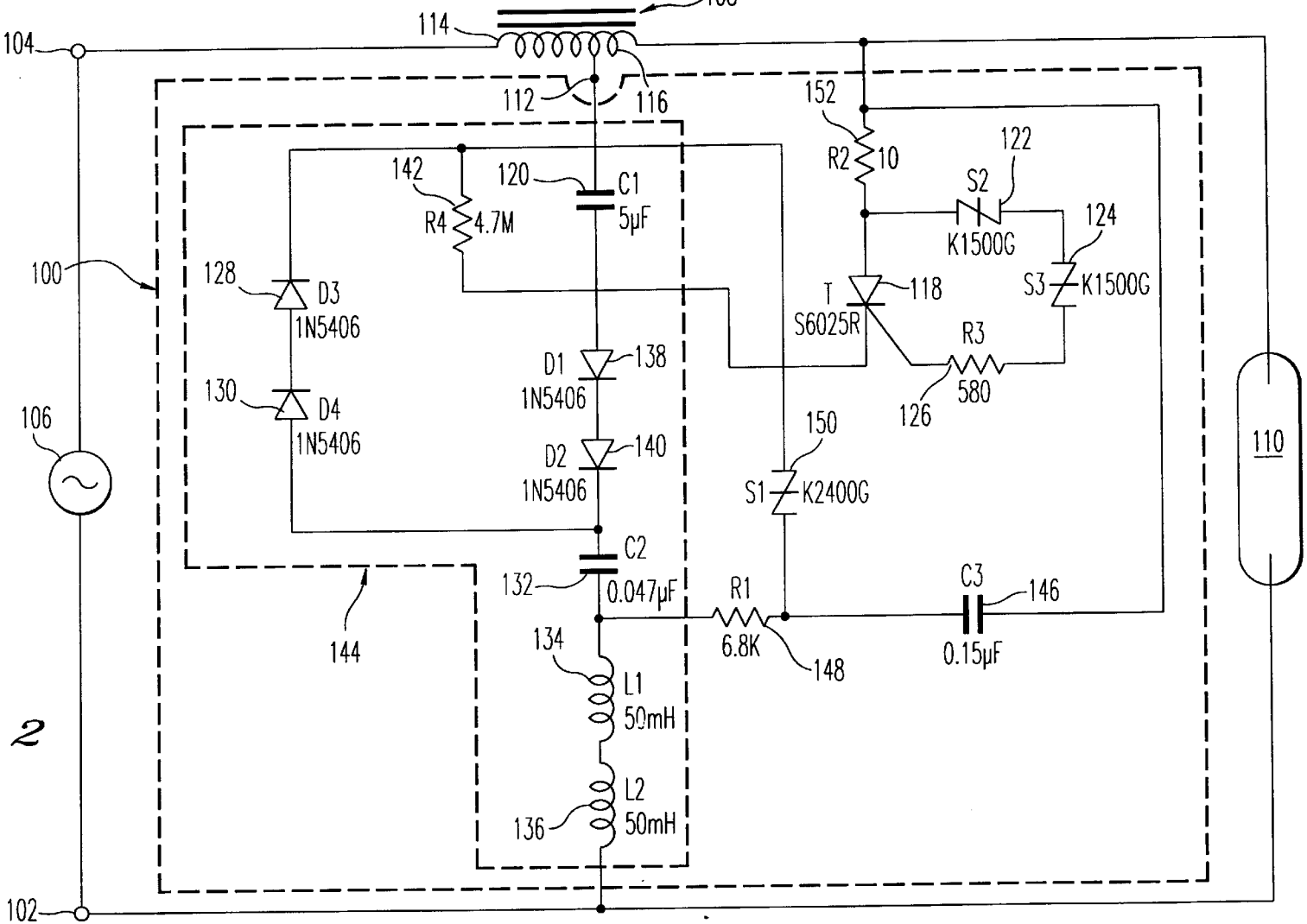
FIG. 2 is a schematic diagram of an ignitor constructed in accordance with a first embodiment of the present invention.

With reference to FIG. 2, an ignitor 100 constructed in accordance with an embodiment of the present invention comprises a number of the circuit components of the starting circuit 60 depicted in FIG. 1. Terminals 102 and 104 of a lighting unit are connected to an AC power source 106, as well as to a ballast 108 and a lamp 110. The ballast 108 comprises a tap 112 and two winding portions 114 and 116. The ignitor 100 has terminals which are connected to terminals 102, 112 and 110. A charging circuit for hot restarting a high pressure xenon HPS lamp or other HID lamp having similar hot restart requirements is provided which comprises a semiconductor switch 118 such as a silicon-controlled rectifier (SCR) or the like is connected so that one end of its switchable conductive path is connected to the end of the first portion 116 of the ballast. The other end of the conductive path of the SCR 118 is connected to the tap 112 via a storage capacitor 120. A number of sidacs 122 or other breakdown devices are connected between the gate and the anode of the SCR 118. A current-limiting resistor 126 is provided in series with the sidacs 122 and 124. If the voltage on the capacitor 120 increases to a level which reaches or exceeds the threshold voltage of the breakdown devices 122 and 124, the sidacs 122 and 124 become conductive, placing the SCR 118 in a conductive state. Accordingly, the capacitor 120 discharges through the portion 116 of the ballast. Because the winding portions 114 and 116 of the ballast are electromagnetically coupled, the portion 116 of the ballast operates as the primary of a transformer in that a voltage is induced in the winding portion 114. The high voltage generated in the winding portion 114 of the ballast 108 is imposed on the lamp 110. The relationship of the winding portions 114 and 116 is selected to create a voltage using the SCR 118 and the sidacs 122 and 124 which is sufficiently high to ionize the material within the arc tube of the lamp 110.

With further reference to FIG. 2, a charging circuit 144 for the capacitor 120 is connected between the tap 112 and the terminal 102 at the other side of the AC power source 106. This charging circuit preferably comprises two diodes 128 and 130, a pumping capacitor 132 and two radio frequency chokes 134 and 136 connected in series between the tap 112 and the terminal 102. Two diodes 138 and 140 are connected between the capacitors 120 and 132 and are poled in the opposite direction from the diodes 128 and 130.

The charging circuit 144 depicted in FIG. 2 provides for the controlled, step-charging of the storage capacitor 120. During one half cycle of the AC power source 106, a current flows through the chokes 134 and 136, the capacitor 132 and the diodes 128 and 130 to charge the capacitor 132. The capacitor 132 is selected to be relatively smaller than the capacitor 120 (e.g., 0.047 microfarads ($\mu$F) versus 5 $\mu$F). On the next half cycle of the AC power source 106, the capacitor 120 is charged and the voltage across the capacitor 132 increases the incoming half wave from the AC power source 106 so as to provide energy on the order of 2.7 microjoules to the storage capacitor 120. Since the capacitor 120 requires more energy due to its relative size, the capacitor 120 can be provided with energy from both the incoming AC signal and the capacitor 132 in one cycle. On the next half cycle, the capacitor is charged again and delivers energy to the capacitor 120 again on the subsequent half cycle. Thus, the charge on the capacitor 120 is increased with each alternate half cycle using a pumping action.

When the capacitor 120 reaches the breakdown voltage of the sidacs 122 and 124, the sidacs become conductive and therefore render the SCR 118 conductive. The capacitor 120 therefore discharges through the portion 116 of the ballast 108 to generate a high voltage in the portion 114 of the ballast. The large magnitude of the capacitor 120 discharges significantly more energy into the magnetic field of the ballast 108 as compared with a conventional HID lamp ignitor and therefore excites the ballast 108 to a relatively high degree. The highly excited ballast 108, with its corresponding collapsing magnetic field, pushes the lamp into a discharge state and therefore a low impedance state so that the discharge state can be maintained by the normal AC power source 106. The discharging capacitor 120 produces current flow which is in the same direction as the continued current flow produced by the collapsing field, and which is provided through the lamp as the SCR 118 is turned off by the instantaneous back voltage bias placed on the capacitor 120 by the same collapsing field energy. The resistor 152 can be connected in series with the SCR 118 to cause the peak of the high voltage pulse to be lower and the base (i.e., width) of the pulse to be longer. The resistor 152 limits the high voltage and therefore reduces dielectric stress to allow the use of lower cost magnetic components.

The ignitor 100 depicted in FIG. 2 further comprises an HPS lamp starting circuit comprising a capacitor 146 connected in series with a resistor 148 and a sidac 150 or similar breakdown device. The starter circuit 144 is different from the circuit 60 depicted in FIG. 1 in that it eliminates a choke such as the choke 80. The resistor 148 is connected instead to the junction between the inductors 134 and 136 and the capacitor 132. The ignitor 100 also eliminates a thermally-activated switch such as the switch 70 and the resistor 72. In addition, the ignitor 100 comprises a current-limiting resistor 152 in series with the parallel combination of the SCR 118 and the sidacs 122 and 124. The ignitor 100 is advantageous because it is less complex than a circuit such as that shown in FIG. 1.

Figure 3:
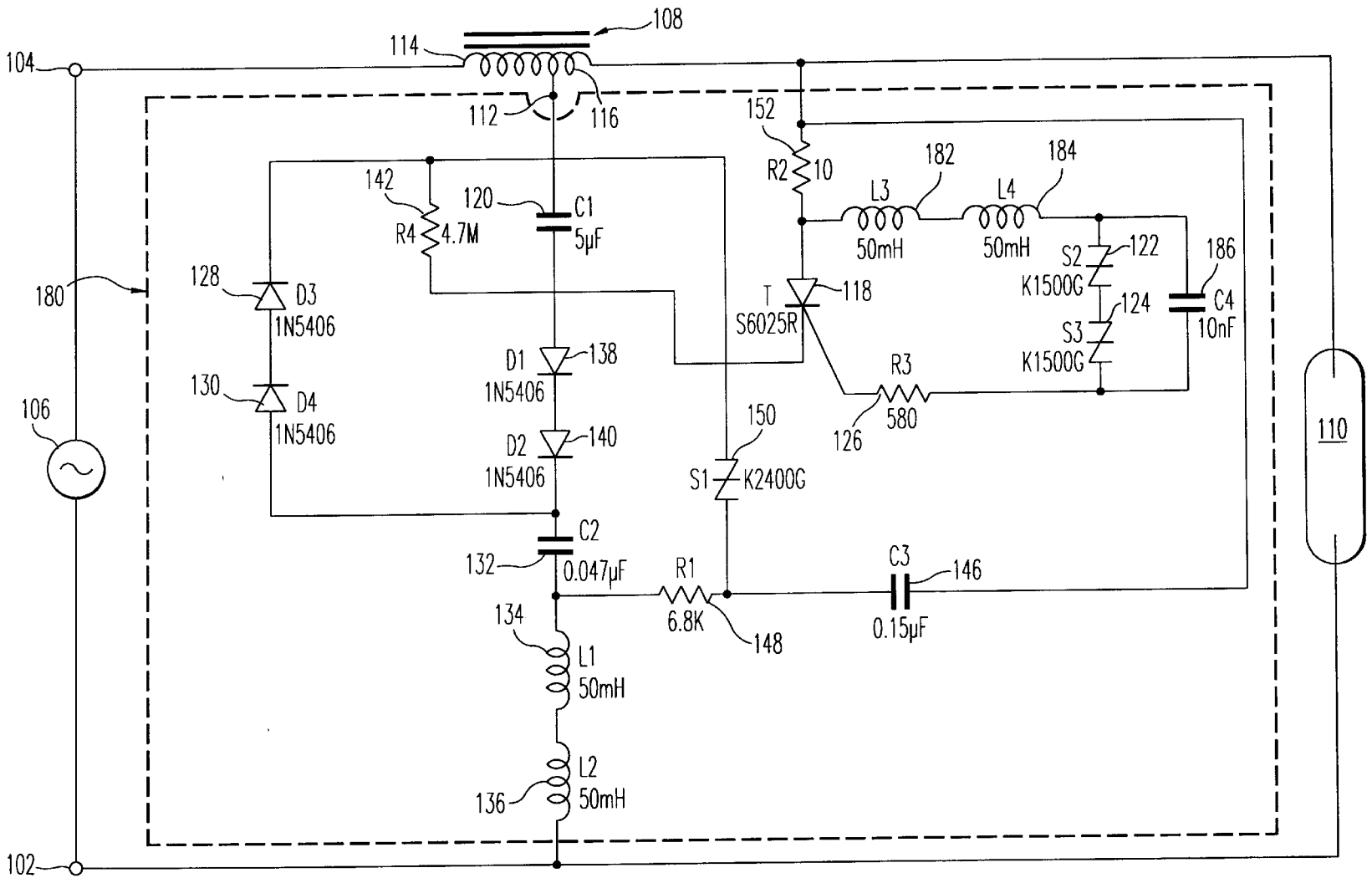
FIG. 3 is a schematic diagram of an ignitor constructed in accordance with a second embodiment of the present invention.

The ignitor 180 depicted in FIG. 3, and constructed in accordance with another embodiment of the present invention, is similar to the ignitor 100. The ignitor 180, however, also comprises a filter network across the trigger of the SCR 118. The filter network can be an L-C or low pass ladder network comprising an inductor 182 and an inductor 184 connected in series with the semiconductor switches 122 and 124. A bypass capacitor 186 is provided in parallel with the semiconductor switches 122 and 124 to reduce the transients across them. The inductors 182 and 184 and the capacitor 186 operate as a low pass filter to attenuate the unwanted high voltage pulses generated via the starting circuit comprising the capacitor 146, the resistor 148 and the sidac 150 which can cause premature triggering of the SCR 118. Thus, the pulse generation of the starting circuit 144 is improved since the capacitor 120 is allowed to achieve a higher voltage before it discharges through the resistor 152 and the SCR 118.

Figure 4:
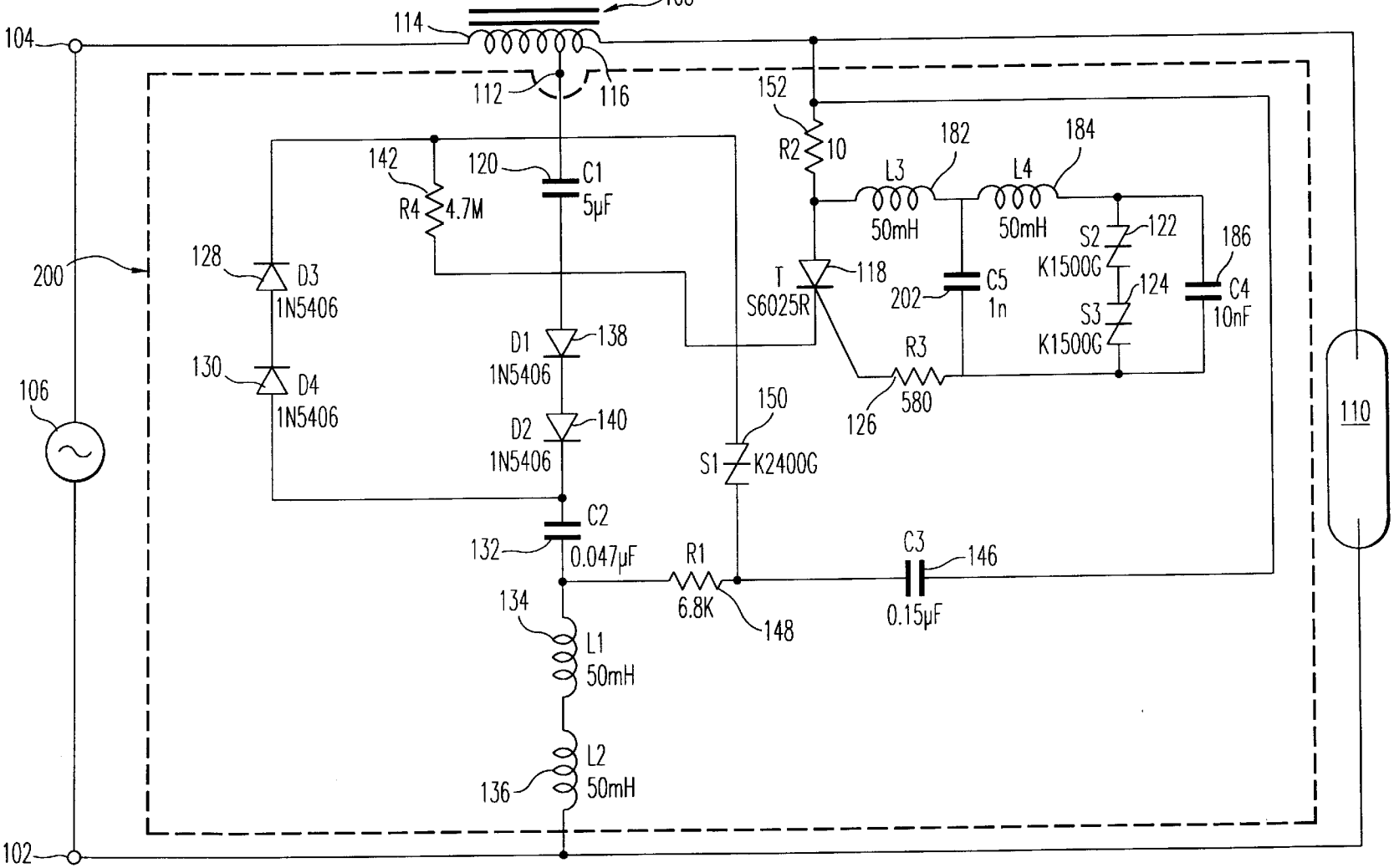
FIG. 4 is a schematic diagram of an ignitor constructed in accordance with a third embodiment of the present invention.

The ignitor 200 depicted in FIG. 4 is similar to the ignitor 180 depicted in FIG. 3, except that the filter network is modified to include the capacitor 202. The capacitor 202 transforms the filter network of FIG. 3 from a two-pole filter network to a four-pole filter network for the improved filtering of unwanted pulses from the capacitor 146 and the breakdown device 150.

Figure 5:
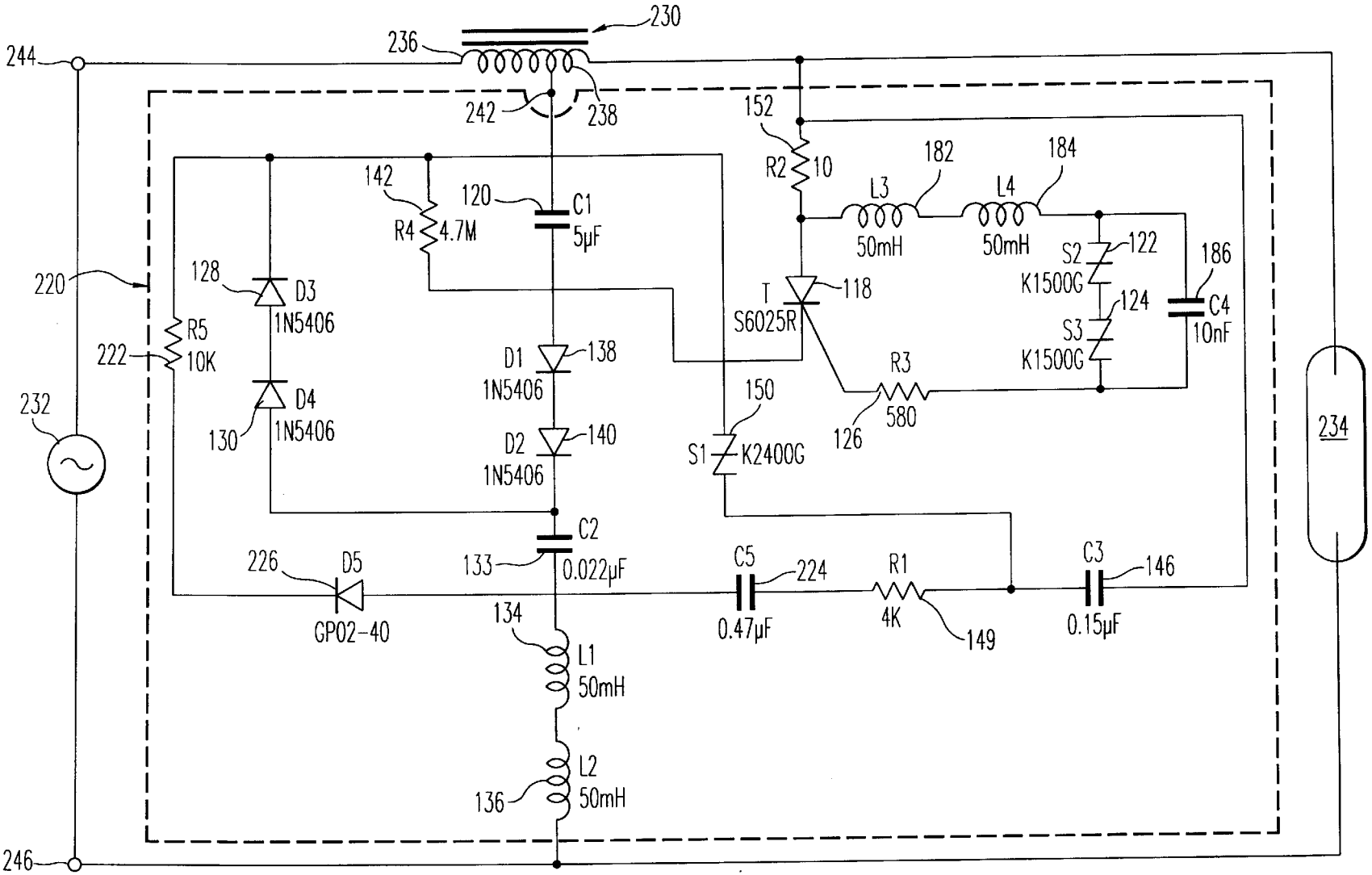
FIG. 5 is a schematic diagram of an ignitor constructed in accordance with a fourth embodiment of the present invention.

The ignitors 100, 180 and 200 depicted in FIGS. 2, 3 and 4, respectively, each operate with a lag-type ballast. In accordance with another embodiment of the present invention which is depicted in FIG. 5, an ignitor 220 is provided for operating with a lead-type ballast (e.g., a constant-wattage autotransformer (CWA) or a peaked-lead autotransformer (PLA) and for performing hot restrike of HID lamps having a hot restrike capability such as high pressure xenon HPS lamps. The ignitor 220 is advantageous since lead-type ballasts account for a large portion of the installed base of the HID lamp market. The ignitor 220 is similar to the ignitor 180 depicted in FIG. 3, except that a resistor 222, a capacitor 224 and a diode 226 have been added as described below.

Figure 6:
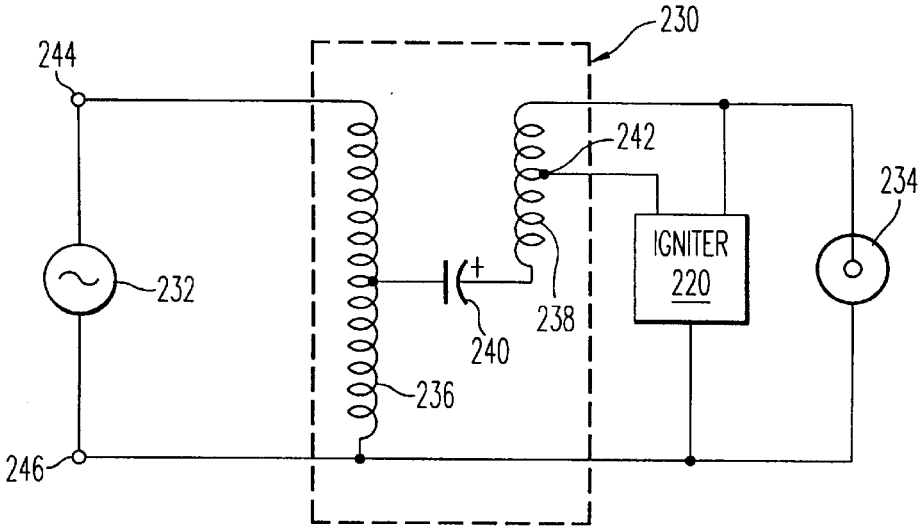
FIG. 6 is a circuit diagram of the ignitor depicted in FIG. 5 connected to lead-type ballast.

An exemplary CWA ballast 230 is depicted in FIG. 6 for illustrative purposes. The CWA ballast 230 comprises a primary winding 236, a secondary winding 238, a ballast capacitor 240 and a tap 242 on the secondary winding. The CWA ballast 230 is connected to an AC power source 232 and an HPS lamp 234 capable of hot restrike. Prior to lamp ignition, no current is drawn through the ballast capacitor 240. When the ignitor 220 is connected to the ballast and lamp as shown in FIG. 6, a small amount of current is drawn through the capacitor 240 via the ignitor 220. Since this current is alternating current, no charge on the ballast capacitor results. In accordance with the present invention, the resistor 222 and the diode 226 provide a charge path for a DC bias during every negative half cycle. Current flows through the chokes 134 and 136, the diode 226, the resistor 222, the tap 242, the ballast capacitor 240 and the common or terminal 246 to allow unidirectional current to be drawn through the ballast capacitor 240 during alternating half cycles. Accordingly, the ballast capacitor 240 is permitted to attain a voltage across the terminals thereof as indicated by the "+" on the capacitor 240 in FIG. 6. The capacitor 224 prevents the discharge of the energy stored on the ballast capacitor 240 following the breakover of the sidac 150 through the resistor 148 and the inductors 134 and 136. The remaining components in FIG. 5 are the same as similarly numbered components in FIG. 4, except for the capacitor 133 and the resistor 149 which have different capacitor and resistor values than the components 132 and 148. The capacitor 186 blocks low frequency components to prevent premature discharging of the ballast capacitor 240.

Figure 7:
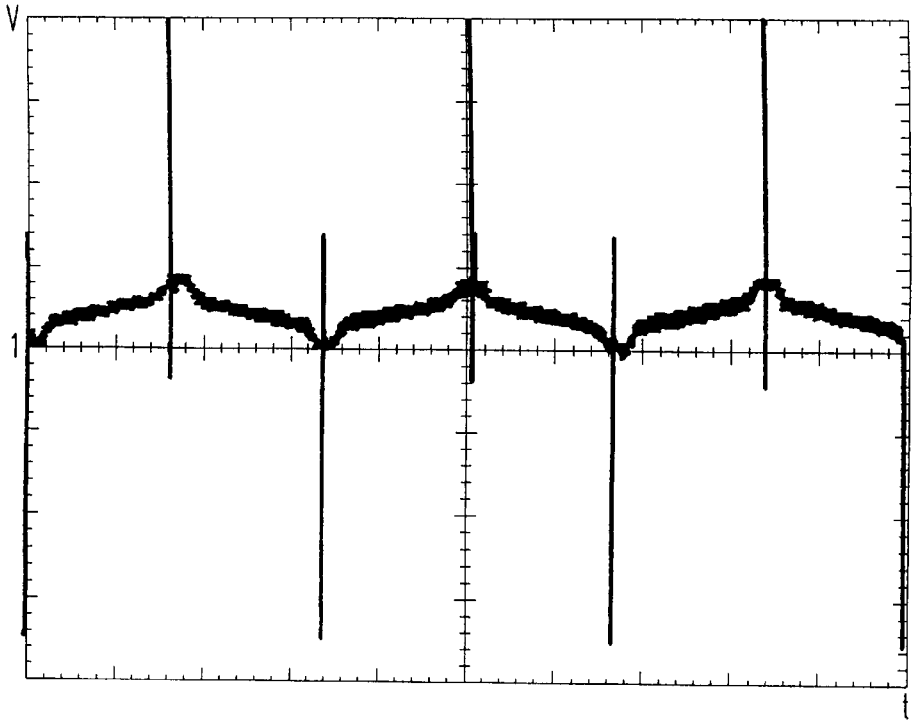
FIG. 7 illustrates an open-circuit voltage waveform of the lamp used with the ignitor depicted in FIG. 5.

The charge stored on the ballast capacitor 240 is useful to assist the lamp 234 into operation during a hot restrike cycle. The DC bias attained via the resistor 222 and the diode 226 is represented in FIG. 7 which depicts the open-circuit waveform of the lamp 234. The DC bias is indicated by the offset of the 60 Hertz component of the waveform above the horizontal axis corresponding to zero volts. Once the lamp 234 begins operating after hot restrike, the DC bias essentially disappears due to the high alternating current drawn through the ballast capacitor 240 via the lamp 234.

The ignitors of the present invention are advantageous because they can be used with either a conventional HID lamp or an HID lamp that is capable of hot restrike such as a high pressure xenon HPS lamp. In the past, these two types of HID lamps generally required different types of ignitors. The demand for high pressure xenon HPS lamps and similar types of lamps is increasing due to increased demand for lighting products which use less mercury. In addition, these types of lamps are beneficial for emergency lighting applications. The ignitors of the present invention allow consumers to choose the desired level of starting performance based upon the type of lamp being used, while using the same type of ignitor.

Although the present invention has been described with reference to a preferred embodiment thereof, it will be understood that the invention is not limited to the details thereof. Various modifications and substitutions have been suggested in the foregoing description, and others will occur to those of ordinary skill in the art. All such substitutions are intended to be embraced within the scope of the invention as defined in the appended claims.

What is claimed is:

1. An ignitor for starting a high intensity discharge lamp, the high intensity discharge lamp receiving power from an alternating current power source via a ballast, comprising:

a storage capacitor;

a voltage response switching device having an anode, a gate and a switchable conductive path connected at one end thereof to a first portion of said ballast, said ballast having a tap between said first portion and a second portion of the secondary winding thereof, the other end of said switchable conductive path being connected to a first terminal of said storage capacitor, said storage capacitor having a second terminal thereof connected to said tap;

at least one breakdown device connected between said anode and said gate of said voltage response switching device and being characterized by a threshold voltage, said breakdown device becoming conductive when said storage capacitor reaches said threshold voltage to place said voltage response switching device in a conductive state and allow said storage capacitor to discharge through said ballast to operate said lamp;

a charging circuit for said storage capacitor comprising a pumping capacitor and at least one inductive device connected in series between said first terminal of said storage capacitor and a common return path to said alternating current power source, said charging circuit being operable to charge said pumping capacitor and to deliver energy to said storage capacitor during alternate half-cycles of said alternating current power source; and a starter circuit comprising a third capacitor, a resistor and a second breakdown device, said third capacitor and said resistor being serially connected between said lamp and said at least one inductive device, said second breakdown device being connected at one end thereof to said tap and at the other end thereof to said third capacitor, said third capacitor being charged through said resistor until said second breakdown device conducts, said third capacitor discharging through at least a portion of said ballast to generate a voltage pulse for said lamp, said at least one inductive device being operable as a choke for said starter circuit.

2. An apparatus as claimed in claim 1, further comprising a current-limiting device connected in series between said anode of said voltage response switching device and said first portion of said ballast.

3. An ignitor for starting a high intensity discharge lamp, the high intensity discharge lamp receiving power from an alternating current power source via a ballast, comprising:

a storage capacitor;

a voltage response switching device having an anode, a gate and a switchable conductive path connected at one end thereof to a first portion of said ballast, said ballast having a tap between said first portion and a second portion of the secondary winding thereof, the other end of said switchable conductive path being connected to a first terminal of said storage capacitor, said storage capacitor having a second terminal thereof connected to said tap;

at least one breakdown device connected between said anode and said gate of said voltage response switching device and being characterized by a threshold voltage, said breakdown device becoming conductive when said storage capacitor reaches said threshold voltage to place said voltage response switching device in a conductive state and allow said storage capacitor to discharge through said ballast to operate said lamp;

a charging circuit for said storage capacitor comprising a pumping capacitor and at least one inductive device connected in series between said first terminal of said storage capacitor and a common return path to said alternating current power source, said charging circuit being operable to charge said pumping capacitor and to deliver energy to said storage capacitor during alternate half-cycles of said alternating current power source;

a starter circuit having a first terminal connected to said tap, a second terminal connected to said lamp and a third terminal connected to one of said at least one inductive device and said common return path; and a low pass filter connected to said voltage response switching device to attenuate unwanted voltage pulses generated by said starter circuit that can cause premature triggering of said voltage response switching device.

4. An apparatus as claimed in claim 3, wherein said low pass filter comprises at least one inductor connected in series with said breakdown device and a capacitor connected in parallel with said breakdown device.

5. An apparatus as claimed in claim 3, wherein said low pass filter comprises a filter network having as many as four poles.

6. An apparatus as claimed in claim 5, wherein said four-pole filter network comprises a first inductor connected in series with said breakdown device and a first capacitor connected in parallel with said breakdown device, and a second inductor and a second capacitor connected across said anode and said gate of said voltage response switching device.

7. An apparatus as claimed in claim 3, wherein said ballast is a lead-type ballast having a ballast capacitor, said apparatus further comprising a diode and a resistor connected in series between said tap and one of said at least one inductive device and said common return path, said resister and said diode being operable to provide a charge path to generate a direct current bias across said ballast capacitor during alternate half-cycles of said alternating current power source, said direct current bias allowing said ballast capacitor to facilitate hot restrike of said lamp.

8. An apparatus as claimed in claim 7, further comprising a capacitor connected between said diode and said starter circuit to prevent discharging of said ballast capacitor until said threshold voltage of said breakdown device is reached.

9. An apparatus as claimed in claim 7, wherein said diode is configured to facilitate unidirectional flow of current through said resistor and said ballast capacitor to attain said direct current bias.

10. A method of hot restriking a high intensity discharge lamp comprising the steps of:

charging a storage capacitor connected to the ballast of said lamp;

operating a voltage response switching device to conduct current when said storage capacitor reaches a selected charge;

generating a high voltage pulse by discharging said storage capacitor when said voltage response switching device conducts current to hot restrike said lamp; and reducing pulses generated by a starter circuit for said lamp to prevent false triggering of said voltage response switching device.

11. A method as claimed in claim 10, wherein said storage capacitor is connected to a charging circuit and said lamp is provided with a starter circuit, and said charging circuit and said starter circuit use a common choke.

12. A method as claimed in claim 10, wherein said reducing step comprises the step of filtering said pulses generated by said starter circuit.

13. A method as claimed in claim 12, wherein said filtering step comprises the step of connecting said voltage response switching device to a low pass ladder network.

14. A method as claimed in claim 13, wherein said ballast is a lead-type ballast and comprises a ballast capacitor and further comprising the step of generating a direct current bias across said ballast capacitor to facilitate hot restriking said lamp.

* * * * *